US005957732A

United States Patent [19]

Ito et al.

[11] Patent Number: 5,957,732

[45] Date of Patent: Sep. 28, 1999

[54] CONNECTOR

[75] Inventors: Osamu Ito; Makoto Fukamachi, both of Yokkaichi, Japan

[73] Assignee: Sumitomo Wiring Systems, Ltd., Japan

[21] Appl. No.: 09/000,700

[22] Filed: Dec. 30, 1997

[30] Foreign Application Priority Data

Jan. 14, 1997 [JP] Japan ..... 9-004981

[51] Int. Cl.[6] ..... H01R 13/434

[52] U.S. Cl. ..... 439/752; 439/701

[58] Field of Search ..... 439/695, 696, 439/701, 404, 752

[56] References Cited

U.S. PATENT DOCUMENTS 4,671,601 6/1987 Lomecka ..... 439/404
5,122,077 6/1992 Maejima et al. ..... 439/404
5,573,430 11/1996 Hatagishi ..... 439/701

FOREIGN PATENT DOCUMENTS 3526664 2/1986 Germany ..... 439/695
2-223171 7/1990 Japan .

*Primary Examiner*—Gary F. Paumen
*Attorney, Agent, or Firm*—Anthony J. Casella; Gerald E. Hespos; Ludomir A. Budzyn

[57] ABSTRACT

A multilevel connector is provided for securely engaging male and female connector housings. The connector 1 includes a main block 4 integrally formed with a receptacle 3, an auxiliary block 5 to be assembled with the main block 4 and a lid 6 to be assembled so as to cover the auxiliary block 5. Terminal cavities 2A are arranged side by side in each of the main and auxiliary blocks 4, 5.

12 Claims, 7 Drawing Sheets

CONNECTOR

BACKGROUND OF THE INVENTION

1. Field of the Invention

The present invention relates to a connector, in particular to a cramping connector.

2. Description of the Prior Art

An exemplary prior art cramping connector is shown in FIGS. 6 and 7 and is identified by the numeral 60. The cramping connector 60 is of a so-called multilevel type, and is constructed such that a multitude of blocks 62 provided with terminal cavities 61 arranged side by side. The blocks 62 are placed one over another and a lid 63 is mounted on the top. In each block 62, the rear parts of the terminal cavities 61 are open upwardly to improve efficiency by enabling the connection of wires with unillustrated terminal fittings formed with blades inside each block 62. More particularly, the unillustrated terminal fittings are inserted into the terminal cavities 61. The wires then are pressed into cramping portions of the terminal fittings from above. As a result, the blades of the terminal fittings cut the insulation coatings of the wires to establish an electrical connection with cores of the wires.

When male and female connectors are engaged with each other, a receptacle having a rectangular tubular shape is generally formed at an engaging portion of one connector (normally, male connector). The multilevel cramping connector, as described above, is divided into a plurality of blocks. Thus if a receptacle is simply formed, it needs to be divided in a similar manner. If the rectangular tubular portion is vertically divided, the side walls of the respective blocks are deformed inwardly for some reason caused by molding. Even if an adjustment is made, a proper rectangular tubular shape may not be obtained. This may cause an insufficient engagement of the male and female connectors.

The present invention was developed in view of the above problem and an object thereof is to effect a secure engagement of male and female connectors in a multilevel connector.

SUMMARY OF THE INVENTION

According to the invention, there is provided a connector, in particular a cramping connector, having a connector housing with terminal cavities formed therein. Terminal fittings are accommodated in the respective terminal cavities of the connector housing. The terminal fittings each are provided with a wire connection portion for an electrical connection with a wire and a connection portion to be electrically connected with a mating terminal fitting when a mating connector housing is engaged. The connector housing comprises at least a main block and an auxiliary block which can be placed substantially one over another in a direction of height. The main block is formed with a common hood or receptacle which accommodates all terminal fittings when the respective blocks are assembled and is engageable with the mating connector housing.

Accordingly, since the receptacle is shared by the respective blocks, i.e. only the receptacle is not divided, it is unlikely to undergo a deformation due to its high rigidity. Further, male and female connectors can be engaged smoothly.

According to a preferred embodiment, the terminal fittings are cramping terminals and the wire connection portion comprises a cramping portion for cutting the insulation coating of the wire to establish an electrical connection with a core of the wire.

Accordingly a simple and easy to achieve electrical connection of the terminal fitting and the wire is provided.

Preferably, the terminal cavities of the respective blocks are substantially open upwardly so that the connection portions, in particular the pressing or cramping portions of the terminal fittings can be substantially exposed.

Accordingly, the electrical connection of the wires with the terminal fittings is more easily achievable, since the connection portions are accessible or open or reachable, in particular by a jig or the like connecting means.

Further preferably, there is provided a cramping connector in which cramping terminals each are provided with a cramping portion for cutting the insulation coating of a wire to establish an electrical connection with a core of the wire and a connection portion to be electrically connected with a mating terminal fitting when a mating connector housing is engaged. The cramping terminals are accommodated in terminal cavities formed in a connector housing. The connector housing comprises a plurality of blocks which can be placed one over another in a direction of height. The terminal cavities of the respective blocks are open upwardly so that the pressing portions of the terminal fittings are to be exposed. One of the blocks is formed with a common receptacle which accommodates all terminal fittings when the respective blocks are assembled and is engageable with the mating connector housing.

Still further preferably, the main block formed with the receptacle and/or the auxiliary block is provided with a guide means for guiding the assembling of the auxiliary block with the main block. Accordingly, the blocks can be easily assembled because the guide means is provided.

Most preferably, the guide means comprises one or more slidable portions and one or more mating guide grooves. The slidable portions can be inserted or fitted or slid in the guide grooves substantially along a direction of assembling of the blocks. The assembling direction preferably is arranged at an angle different from 0° or 180°, preferably substantially normal with respect to the direction of height.

According to a further preferred embodiment, one, preferably the upper one of the adjacent blocks to be assembled substantially one over the other is provided with a correcting portion for pressing the insufficiently inserted terminal fittings to their proper insertion positions as the upper block is assembled. Accordingly, the insufficient insertion of the terminal fittings can be corrected, taking advantage of the assembling of the blocks.

The correcting portion may interact with or abut against an interaction portion of the terminal fitting substantially along a direction of fitting of the terminal fitting with the mating terminal fitting. The fitting direction preferably is arranged at an angle different from 0° or 180°, preferably substantially normal with respect to the direction of height.

Further preferably, the interaction portion comprises a bridging portion substantially bridging or interconnecting side wall portions of the terminal fittings.

Still further preferably, the connector housing further comprises an auxiliary housing portion, preferably a lid, having at least one lock means which is engageable with at least one lock portion provided on the main block.

Accordingly the connector can be stabilized and preferably substantially closed, so that the terminal fittings are not exposed in positions not intended for an electric connection.

Still further preferably, the at least one auxiliary block is arranged substantially between the main block and the auxiliary housing portion in the engaged state of the lock means and the lock portion.

Accordingly the overall stiffness or rigidity and the stability of the connector can be augmented advantageously, as the blocks are securely positioned substantially between the main block and the auxiliary housing portion, preferably the lid. Furthermore the connector is overall more compact.

Still further preferably, the terminal fittings comprise one or more stabilizer portions for stabilizing and/or positioning the terminal fittings in the terminal cavities, preferably by interacting with lateral portions thereof.

Accordingly, the terminal fittings are mechanically stabilized, thus improving their positioning and/or connectability with the mating terminal fitting.

Most preferably, the terminal cavities comprise, preferably in the substantially middle thereof, an engaging portion being insertable into an engaging hole of the terminal fittings for positioning and/or holding the terminal fittings in the terminal cavities.

These and other objects, features and advantages of the present invention will become more apparent upon a reading of the following detailed description and accompanying drawings.

DETAILED DESCRIPTION OF THE PREFERRED EMBODIMENT

Figure 1:
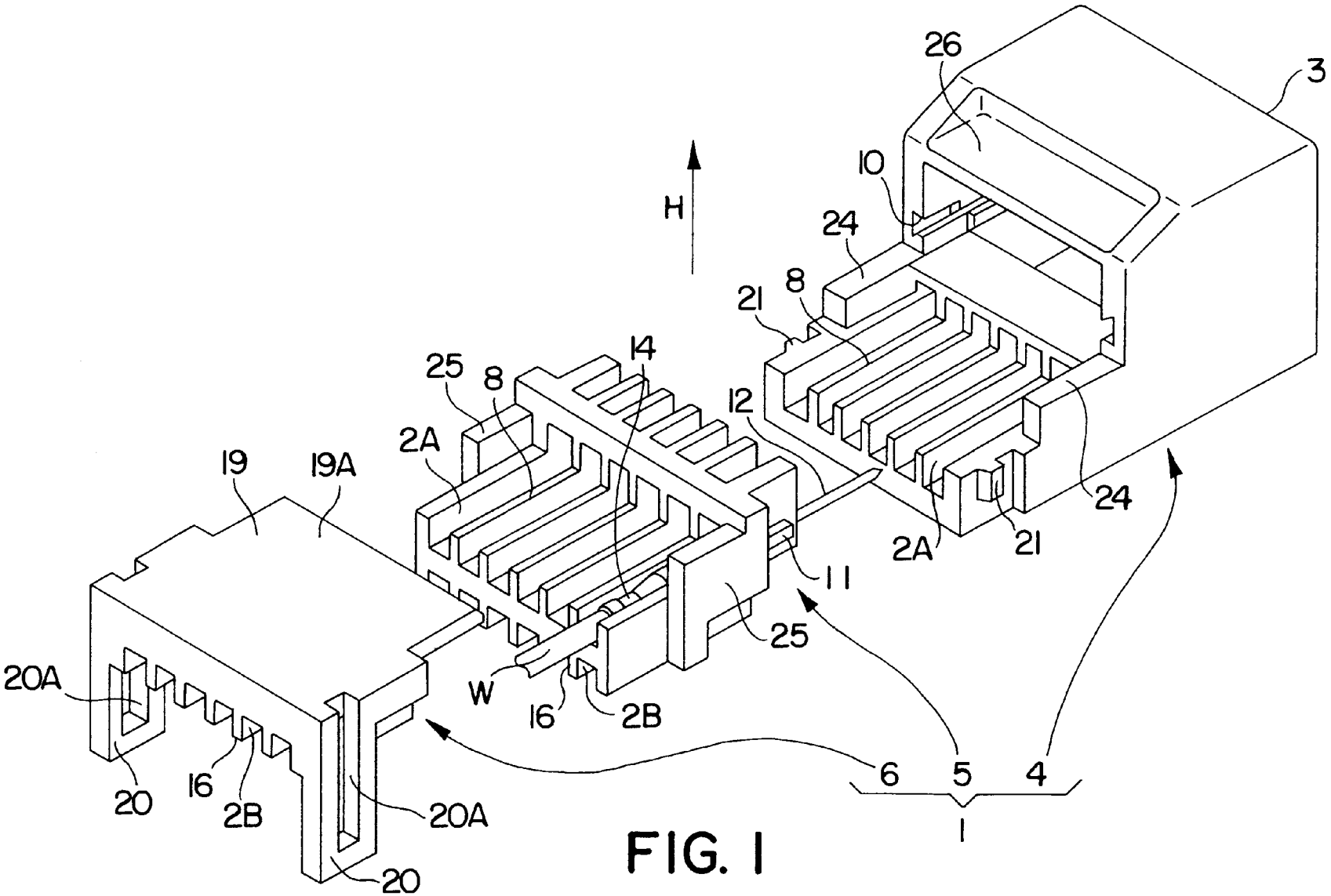
FIG. 1 is a perspective view of a cramping connector before being assembled.
Figure 2:
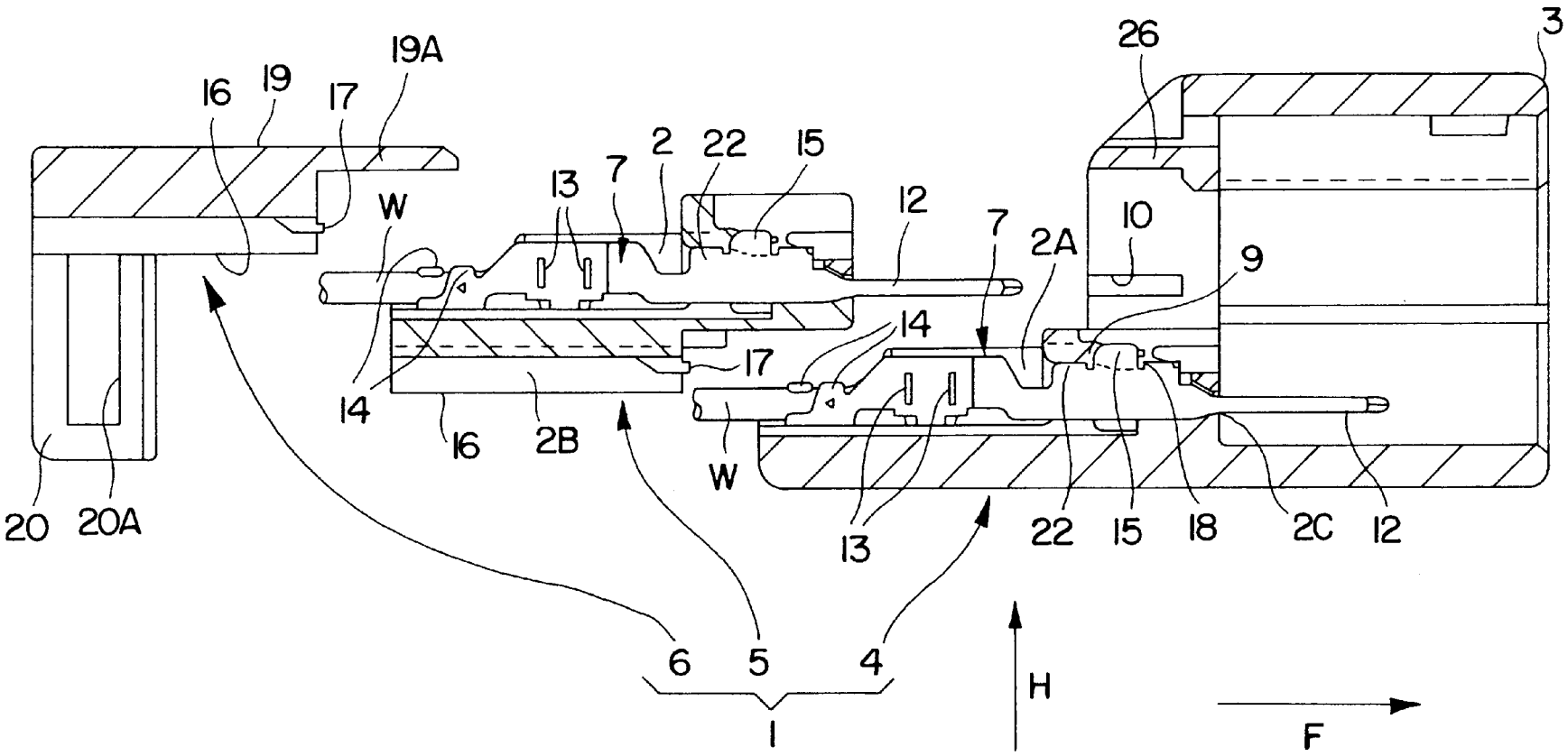
FIG. 2 is a side view in section of the cramping connector before being assembled.
Figure 3:
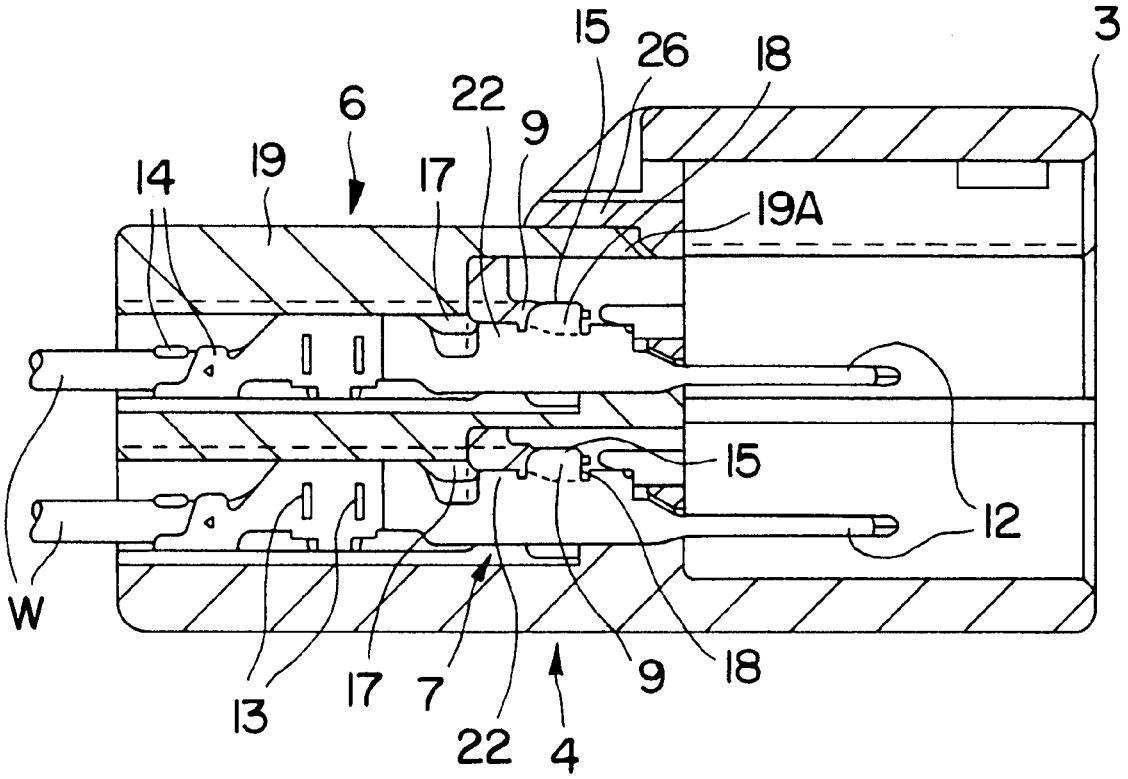
FIG. 3 is a side view in section of the assembled cramping connector.
Figure 4:
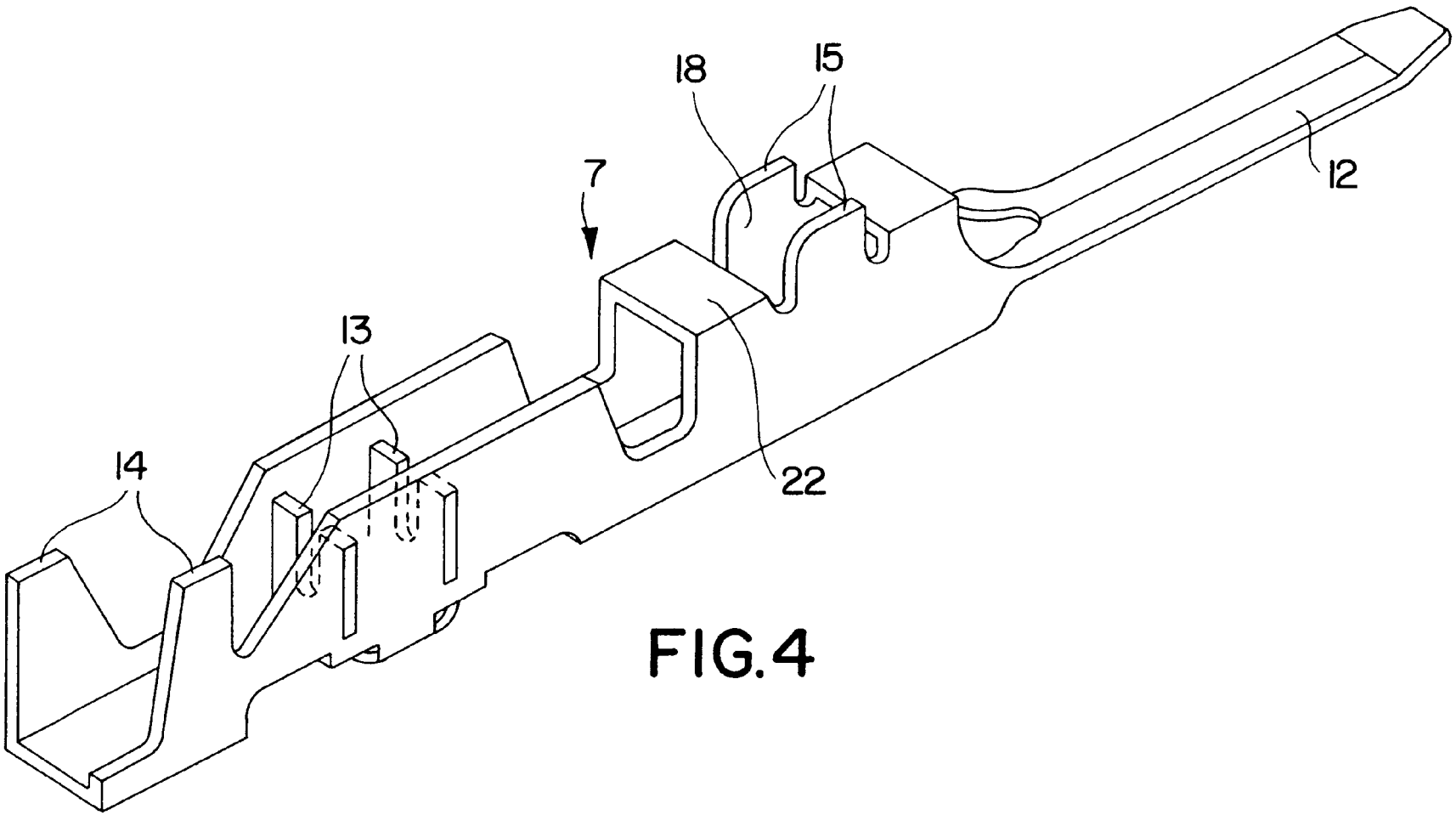
FIG. 4 is a perspective view of a male terminal fitting.
Figure 5:
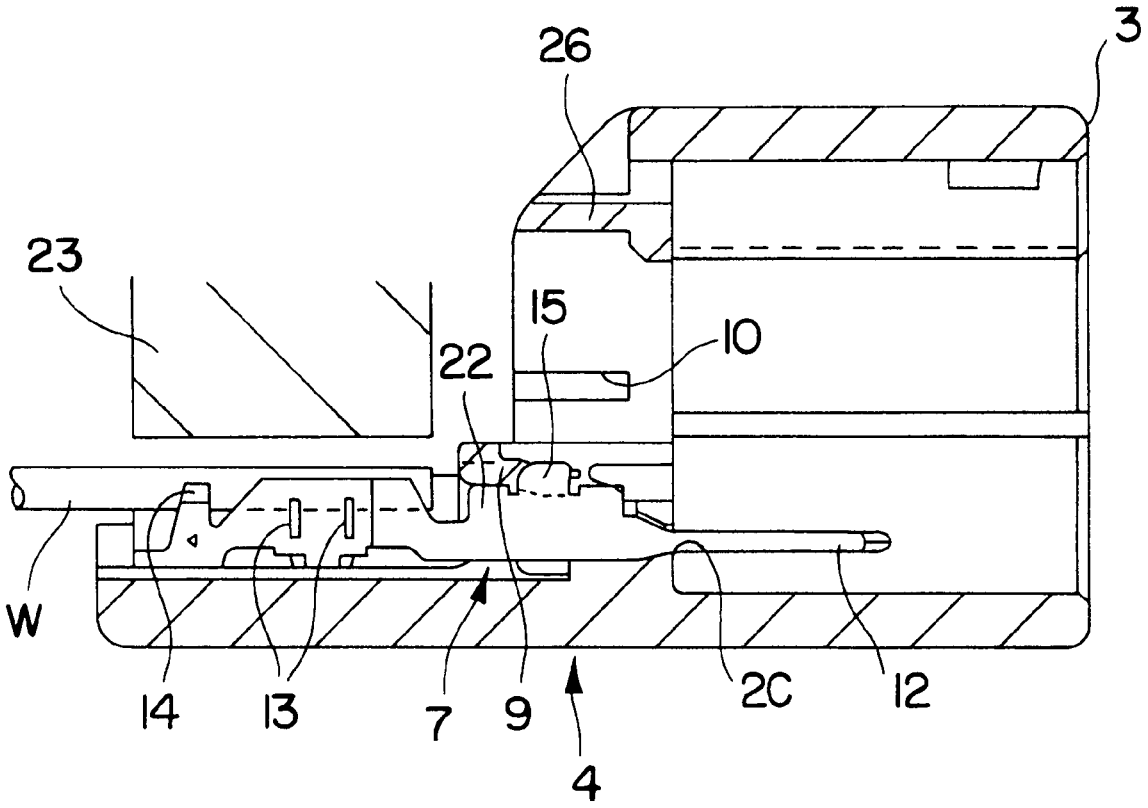
FIG. 5 is a section showing the connection of a wire with a terminal fitting mounted in the bottommost level of the cramping connector.
Figure 6:
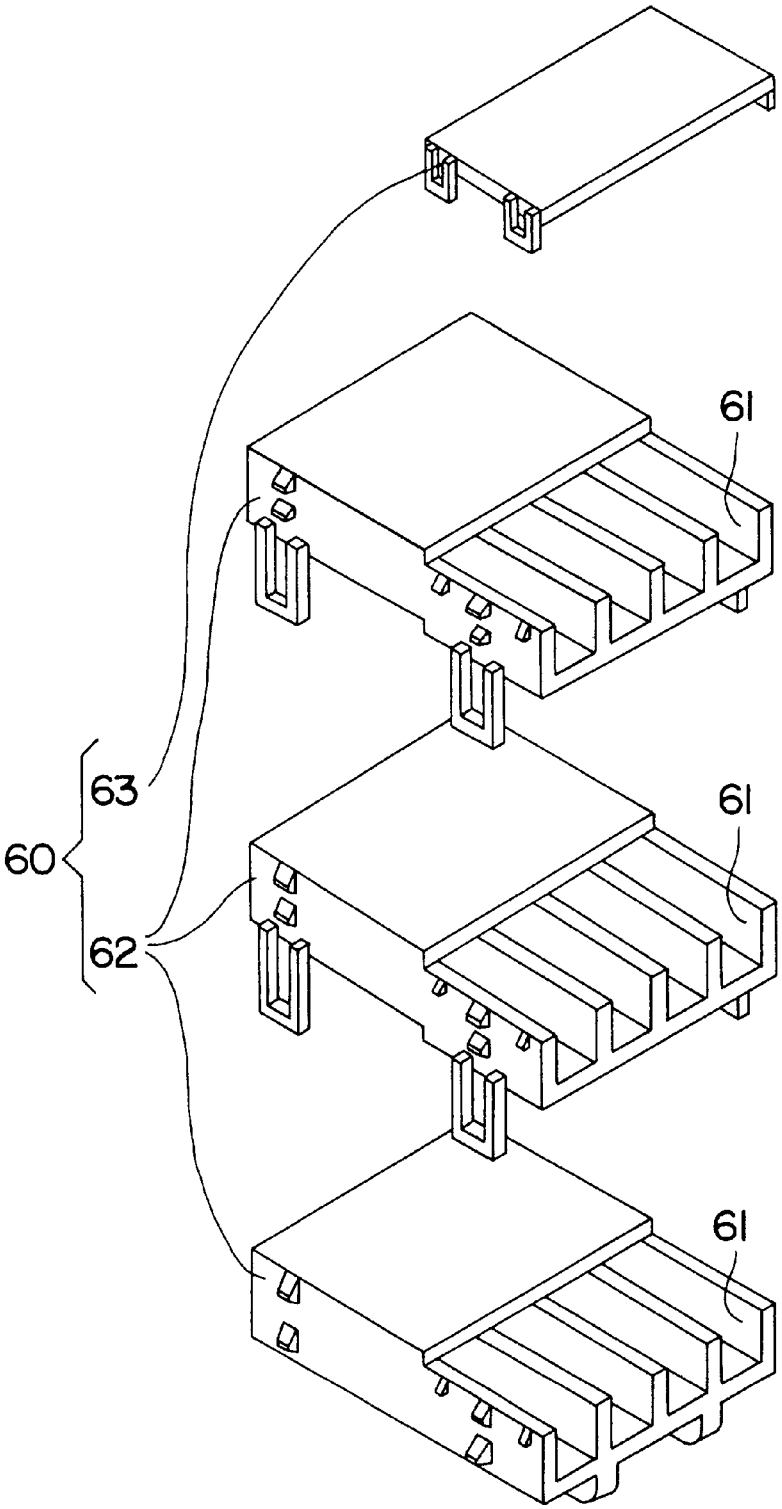
FIG. 6 PRIOR ART
FIG. 6 is a perspective view of a prior art cramping connector before being assembled.
Figure 7:
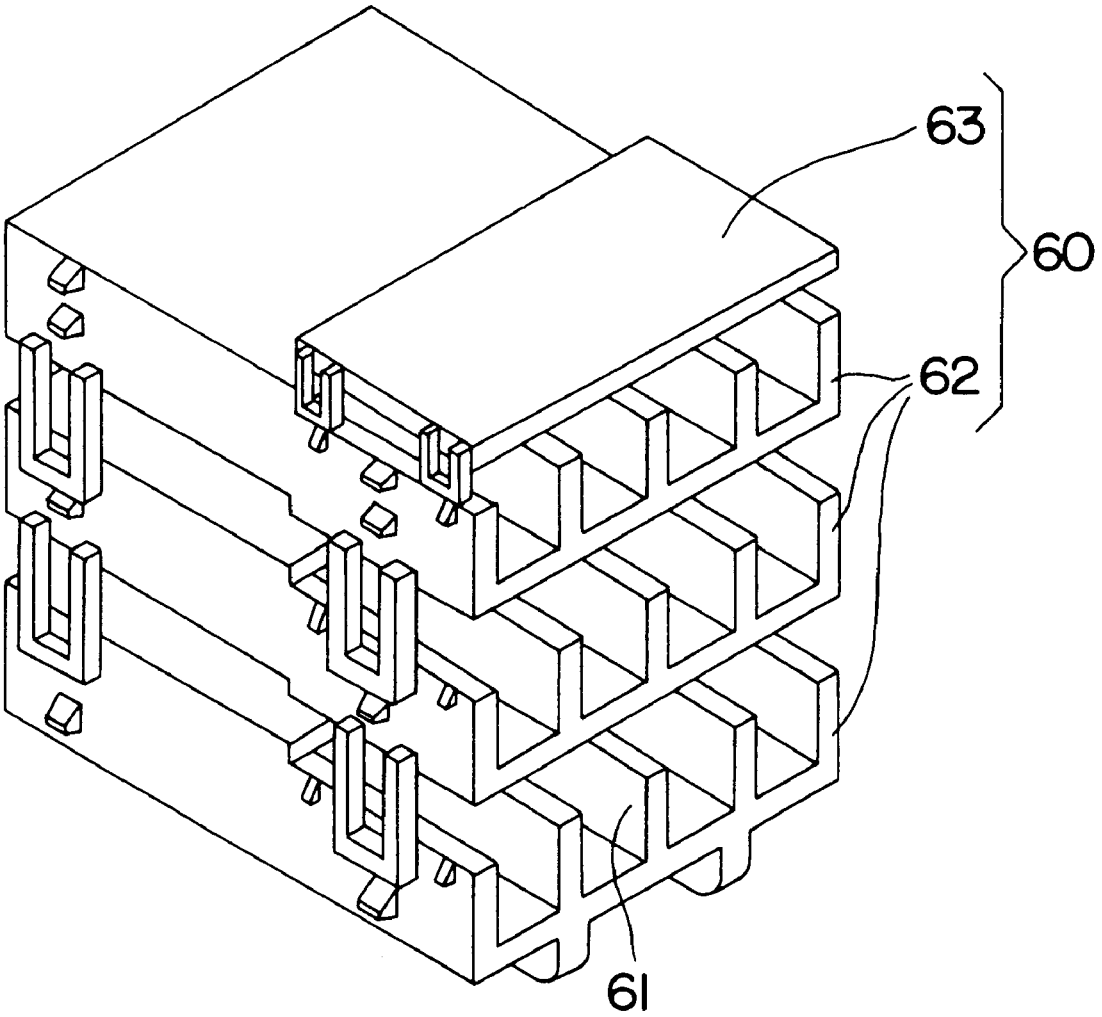
FIG. 7 PRIOR ART
FIG. 7 is a perspective view of the prior art cramping connector.

Next, one embodiment of the invention is described with reference to FIGS. 1 to 5. Here, description is not given on a part of the same or similar construction as that of the prior art by identifying it by the same reference numerals.

A cramping connector 1 according to this embodiment is of two-level type, and is comprised of a main block 4 having a hood or receptacle 3, an auxiliary block 5 to be placed substantially on the main block 4 in a direction of height H and a lid 6 for substantially covering an upper part of the auxiliary block 5.

The main block 4 is formed integrally or unitarily, e.g. of a synthetic resin, and accommodates terminal fittings 7 (male) substantially inside. Upon the engagement with an unillustrated mating connector housing (female) in a fitting direction F being arranged at an angle different from 0° or 180°, preferably substantially normal to the direction of height H, male and female terminal fittings are connected to establish an electrical connection. In a rear part of the main block 4, terminal cavities 2A for accommodating the terminal fittings 7 are substantially open upwardly and are arranged substantially side by side. These terminal cavities 2A belong to the lower level. Terminal cavities 2B of the upper level are provided in the auxiliary block 5. More accurately, complete terminal cavities are formed by assembling the main and auxiliary blocks 4, 5. In a front part of the main block 4 is formed the receptacle 3 for the engagement of the mating connector. The bottom surface of the main block 4 is substantially planar preferably all the way from the receptacle 3 to the terminal cavities 2A.

An elastically deformable lance or engaging portion 9 projects forwardly (i.e. toward the receptacle 3 substantially along the fitting direction F) from the upper wall surface of each terminal cavity 2A. The engaging portion 9 is engageable with a corresponding lance hole or engaging hole 18 of the terminal fitting 7. The front end of each terminal cavity 2A is substantially open to the receptacle 3, thereby defining a terminal insertion opening 2C. When the terminal fittings 7 are mounted in the terminal cavities 2A, the leading ends (male tabs 12) thereof project into the receptacle 3.

The receptacle 3 preferably has a substantially rectangular tubular shape, and an unillustrated mating connector housing is inserted or insertable thereinto. A pair of guide grooves 10 extend preferably from a substantially middle position to the substantially rear end of the inner side wall surfaces of the receptacle 3. When the auxiliary block 5 is assembled with the main block 4, slidable portions 11 of the auxiliary block 5 are fitted or inserted slidably into the guide grooves 10. A pressing portion 26 is formed preferably in an upper rear portion of the receptacle 3. Upon the completion of assembling of the cramping connector 1, a lift preventing portion 19A of the lid 6A is positioned radially inwardly of or below the pressing portion 26.

The respective terminal cavities 2A preferably are partitioned equally by lower partition walls 8 extending from the rear end of the main block 4 to the receptacle 3. Further, a step wall 24 is formed in a position of the upper edge of each side wall of the main block 4 toward the receptacle 3. A pair of engaging projections 21 for the engagement with the lid 6 to be described later project from the substantially opposite side walls behind the step wall 24.

The terminal fitting 7 is formed e.g. by bending a conductive metal plate. A front portion of the terminal fitting 7 serves as the male tab 12 to be engaged with an unillustrated mating female terminal fitting, and stabilizers 15 are formed at the opposite side walls behind the male tab 12 e.g. by raising cut portions to upright positions. A hole e.g. left by raising the cut portions to the upright positions is the engaging hole 18 in which the engaging portion 9 is fittable (see FIG. 4). Behind (as seen in the fitting direction F) the stabilizers 15, a bridge 22 connects the left and right side walls of the terminal fitting 7. The auxiliary block 5 and a press projection 17 of the lid 6 come substantially into contact with the rear end of the bridge 22.

In a substantially middle part of the terminal fitting 7, a pair of blades 13 having preferably a substantially V-shaped cross section are provided one after the other in order to cut the insulation coating of a wire W until the core thereof is reached to establish an electrical connection between the wire W and the terminal fitting 7. The blades 13 are formed e.g. by cutting the bottom wall of the terminal fitting 7 and raising the cut portions to positions where they substantially face each other. Projected portions are formed at the opposite ends of each blade 13. The blade 13 provided with the projected portions can be held or positioned in position by being held between the side walls of the terminal fitting 7.

At a rear end of the terminal fitting 7, barrel portions 14 for fastening the wire W project upward from the substantially opposite side walls.

The auxiliary block 5 is formed integrally or unitarily e.g. of a synthetic resin, and accommodates the terminal fittings 7 inside. The auxiliary block 5 is assembled so as to substantially cover the upper openings of the terminal cavities 2A of the main block 4. Terminal cavities 2A also are arranged substantially side by side in the auxiliary block 5 and are partitioned by the lower partition walls 8 similar to the main block 4. Further, upper partition walls 16 project from the bottom surface of the auxiliary block 5, and upper terminal cavities 2B are defined between adjacent upper partition walls 16. The upper partition walls 16 substantially come into contact with the upper edges of the lower partition walls 8 to combine the upper and lower terminal cavities 2A, 2B. The press projections 17 project forwardly between two adjacent lower partition walls 8. The press projections 17 substantially come into contact with the rear ends of the bridges 22 of the terminal fittings 7 mounted in the main block 4 when the auxiliary block 5 is assembled with the main block 4.

A pair of slidable portions 11 substantially project at front portions of the opposite side surfaces of the auxiliary block 5. The slidable portions 11 are slid substantially into the guide grooves 10 formed in the receptacle 3 of the main block 4 from behind (i.e. from a direction opposed to the tabs 12). Thus, if the terminal fittings 7 are not sufficiently inserted into the terminal cavities 2A, the press projections 17 press the terminal fittings 7 in the main block 4 to their proper positions as the auxiliary block 5 is mounted.

In the middle portions of the opposite side surfaces of the auxiliary block 5, there are formed side wall portions 25 preferably where the thickness is larger than other parts of the side walls. A lower part of each side wall portions 25 is formed to be brought substantially into contact with the upper and side surfaces of the corresponding step wall 24 of the main block 4. Further, the rear edges of the side wall portions 25 extend substantially vertically so that the front edges of lock frames 20 of the lid 6 substantially come into contact therewith.

The lid 6 is formed integrally or unitarily e.g. of a synthetic resin, and is assembled with the auxiliary block 5 and the main block 4 to cover the terminal cavities 2A of the auxiliary block 5 substantially entirely. An upper part of the lid 6 is preferably a substantially rectangular shaped base plate 19, a front portion of which serves as the lift preventing portion 19A for slipping under the pressing portion 26 of the main block 4.

A pair of lock frames 20 hang from the substantially opposite side surfaces of a rear portion of the base plate 19. The lock frames 20 are elastically deformable in directions away from each other. A substantially vertically extending groove 20A is formed in a middle portion of each lock frame 20. When the lid 6 is assembled with the main block 4, the engaging projections 21 formed on the main block 4 are fitted into these grooves 20A. In this way, the lid 6 is assembled with the main block 4 with the auxiliary block 5 therebetween.

Similar to the construction at the bottom surface of the auxiliary block 5, upper partition walls 16 project from the lower surface of the base plate 19 so as to partition the terminal cavities 2A of the auxiliary block 5, and the press projections 17 project forwardly substantially between two adjacent upper partition walls 16.

Next, the action and effects of the thus constructed embodiment are described.

First, the terminal fittings 7 are inserted into the terminal cavities 2A of the main block 4. After being placed on the terminal fittings 7, the wires W are connected to the terminal fittings 7, e.g. by being pressed into the corresponding pairs of blades 13 e.g. using a press jig 23 or the like pressing apparatus of a connecting apparatus (see FIG. 5). Then, the blades 13 cut the insulation coatings of the wires W and are brought into contact with the cores of the wires W, thereby establishing an electrical connection between the wires W and the terminal fittings 7. Further, by pressing the terminal fittings 7 by the press jig 23, the wires W are fastened in the barrel portions 14. At this time, since the bottom surface of the main block 4 is preferably planar as a whole, it is not necessary to provide special recess(es) and projection(s) on a table where the pressing operation is performed.

On the other hand, an operation similar to the above is performed for the auxiliary block 5 before being assembled, i.e. the terminal fittings 7 are mounted in the terminal cavities 2A and the wires W are connected therewith.

Subsequently, the auxiliary block 5 mounted with the terminal fittings 7 is assembled with the main block 4 from behind. Specifically, the auxiliary block 5 is assembled with the main block 4 by sliding the slidable portions 11 formed on the substantially opposite side walls of the auxiliary block 5 into the guide grooves 10 of the receptacle 3. At this time, the assembling of the blocks 4, 5 is facilitated by being guided by the slidable portions 11 and the guide grooves 10. Further, at this time, the press projections 17 provided substantially between the upper partition walls 16 of the auxiliary block 5 press the rear ends of the bridges 22 of the terminal fittings 7 mounted in the main block 4. Thus, even if the terminal fittings 7 are insufficiently inserted in the main block 4, their positions are corrected to their proper insertion positions using the assembling operation of the auxiliary block 5.

Further, the lid 6 is assembled from behind above the auxiliary block 5 by pressing the lift preventing portion 19A of the base plate 19 of the lid 6 so as to be slipped under the pressing portion 26. At this time, the pressing projections 17 provided on the lower surface of the base plate 19 press the rear end of the bridges 22 of the terminal fittings 7 of the auxiliary block 5. Thus, the insufficient insertion of the terminal fittings 7 is substantially corrected as described above. Simultaneously with this operation, the front portions of the lock frames 20 are deformed away from each other in order to move over the engaging projections 21 of the main block 4. Consequently, the engaging projections 21 are fitted into the grooves 20A, completing the assembling of the cramping terminal according to this embodiment.

According to this embodiment, the auxiliary block 5 is formed with only the elements necessary to hold the terminal fittings 7, and the receptacle 3 of the main block 4 is shared by the main block 4 and the auxiliary block 5. Accordingly, even if the block for accommodating the terminal fittings 7 is divided into two, the receptacle 3 itself is an integral one having no joining surfaces along vertical direction. Thus, as compared with a sectioned receptacle, rigidity is higher and an excellent shape holding function is ensured. As a result, the male and terminal connectors can be smoothly engaged.

The present invention is not limited to the foregoing embodiment. For example, following embodiments are also embraced by the technical scope of the present invention as defined in the claims.

Although the present invention is applied to the male connector in the foregoing embodiment, it may also be applied to female connectors.

Although the terminal cavities are arranged in two levels in the foregoing embodiment, they may be arranged in more levels by placing three or more auxiliary blocks one over another.

Converse to the construction of the foregoing embodiment, the upper terminal cavities and the lower terminal cavities may be provided in the main and auxiliary blocks, respectively.

What is claimed is:

1. A connector having a connector housing with a front end for connection with a mating connector housing and a rear end formed with terminal cavities for accommodating terminal fittings, each said terminal fitting being provided with a wire connection end for electrical connection with a wire and a mating end for electrical connection with a mating terminal fitting when the connector housing is connected with the mating connector housing, the connector housing further being formed with a top and a bottom extending between the front and rear ends thereof, wherein: the connector housing comprises:

a main block extending upwardly from the bottom of the connector housing and substantially continuously between the front and rear ends of the connector housing, the main block being formed with a common receptacle at the front end of the connector housing and surrounding the mating ends of all said terminal fittings in the connector housing, the common receptacle being engageable with the mating connector housing, portions of the main block adjacent the rear end of the connector housing defining a first plurality of upwardly open terminal cavities extending from the rear end of the connector housing to the common receptacle;

at least one auxiliary block disposed above portions of the main block defining the terminal cavities and extending from the rear end of the connector housing toward the common receptacle of the main block, the auxiliary block having a bottom substantially closing the upwardly open terminal cavities below the auxiliary block, the auxiliary block further having a top configured to define at least a second plurality of upwardly open terminal cavities extending from the rear end of the connector housing toward the common receptacle; and an auxiliary housing portion lockingly engaged over the auxiliary block and extending from the rear end of the connector housing toward the common receptacle, the auxiliary housing portion having a bottom cooperating with the auxiliary block for substantially closing the second plurality of upwardly open terminal cavities defined in the auxiliary block below the auxiliary housing portion.

2. A connector according to claim 1, wherein the terminal fittings are cramping terminals and wherein the wire connection end comprises a cramping portion for cutting the insulation coating of the wire to establish an electrical connection with a core of the wire.

3. A connector according to claim 2, wherein the cramping portions of the terminal fittings are substantially exposed in the upwardly open terminal cavities of the main block and the auxiliary block.

4. A connector according to claim 1, wherein the main block formed with the receptacle and the auxiliary block are provided with guide means for guiding the auxiliary block and the main block into an assembled condition.

5. A connector according to claim 4, wherein the guide means comprises at least one slidable portion and at least one mating guide groove, wherein the slidable portion can be inserted in the guide groove substantially along a direction of assembling of the blocks, the assembling direction being arranged substantially normal with respect to a direction of height extending between the top and bottom of the connector housing.

6. A connector according to claim 1, wherein the auxiliary housing portion has at least one lock engageable with at least one lock portion provided on the main block.

7. A connector according to claim 6, wherein the auxiliary block is arranged substantially between the main block and the auxiliary housing portion when the lock and the lock portion are engaged.

8. A connector according to claim 1, wherein the main block extends from the top to the bottom of the connector housing at the front end of the connector housing.

9. A connector according to claim 1, wherein the main block includes a pressing wall substantially adjacent the top of the connector housing and adjacent the common receptacle, the auxiliary housing portion having a lift preventing wall slidably insertable under the pressing wall of the main block for preventing upward lifting of the auxiliary housing portion relative to the main block.

10. A connector having a connector housing with a front end for connection with a mating connector housing and a rear end formed with terminal cavities for accommodating terminal fittings, each said terminal fitting being provided with a wire connection end for electrical connection with a wire and a mating end for electrical connection with a mating terminal fitting when the connector housing is connected with the mating connector housing, wherein:

the connector housing comprises at least a main block and an auxiliary block configured for engagement substantially one over another in a direction of height, and the main block being formed with a common receptacle which accommodates the mating ends of all terminal fittings when the mating block and the auxiliary block are assembled, the common receptacle being engageable with the mating connector housing, one of the main and auxiliary blocks being provided with a correcting portion configured for pressing to proper insertion positions any of the terminal fittings that were insufficiently inserted.

11. A connector according to claim 10, wherein the correcting portion interacts with an interaction portion of the terminal fitting substantially along a direction of fitting of the terminal fitting with the mating terminal fitting, the fitting direction being arranged substantially normal with respect to the direction of height.

12. A connector according to claim 11, wherein the interaction portion comprises a bridging portion substantially bridging side wall portions of the terminal fittings.

* * * * *